US006955545B1

(12) United States Patent
Morana et al.

(10) Patent No.: US 6,955,545 B1
(45) Date of Patent: Oct. 18, 2005

(54) TWO PIECE BALL GRID ARRAY

(75) Inventors: Francis P. Morana, Mechanicsburg, PA (US); David S. Szczesny, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/832,554

(22) Filed: Apr. 27, 2004

(51) Int. Cl.[7] ..... H01R 12/00
(52) U.S. Cl. ..... 439/83; 439/856
(58) Field of Search ..... 439/83, 874, 876, 439/891, 246, 249–251, 856, 857; 361/772–776; 174/267

(56) References Cited

U.S. PATENT DOCUMENTS

| | | | | |
|---|---|---|---|---|
| 5,997,317 | A | 12/1999 | Pei et al. | 439/83 |
| 6,024,584 | A | 2/2000 | Lemke et al. | 439/83 |
| 6,099,365 | A | 8/2000 | Cachina et al. | 439/876 |
| 6,155,845 | A * | 12/2000 | Lin et al. | 439/83 |
| 6,461,183 | B1 * | 10/2002 | Ohkita et al. | 439/857 |

* cited by examiner

*Primary Examiner*—P. Austin Bradley
*Assistant Examiner*—Felix O. Figueroa

(57) ABSTRACT

An electrical contact for a ball grid array connector includes a plate for holding a solder ball and a contact body having a first end and a second end. The plate is removably coupled to the body first end. A separable interface extends from the body second end. The separable interface is configured to receive a mating contact.

18 Claims, 4 Drawing Sheets

TWO PIECE BALL GRID ARRAY

BACKGROUND OF THE INVENTION

The invention relates generally to surface mounted connectors on printed circuit boards, and more specifically to a contact for ball grid array connectors.

The ongoing trend toward smaller, lighter, and higher performance electrical components and higher density electrical circuits has led to the development of surface mount technology in the design of printed circuit boards. As is well understood in the art, surface mountable packaging allows for the connection of the package to pads on the surface of the circuit board rather than by contacts or pins soldered in plated holes going through the circuit board, and surface mount technology allows for an increased In order to meet the increasing performance requirements, component density on a circuit board, thereby saving space on the circuit board.

The ball grid array (BGA) is one particular type of surface mount package that has developed in response to the demand created by higher density electrical circuits for increased density of electrical connections on the circuit board. The ball grid array includes an array of connections on the bottom side of the connector package. In the ball grid array, pins extending into the circuit board are replaced by small solder balls placed on the bottom side of the connector at each contact location. The circuit board, rather than holes, has an array of contact pads matching the solder ball placements on the connector bottom. Connections are made by reflowing the solder balls to mechanically and electrically engage the connector to the circuit board.

BGA technology offers the advantages of higher connection densities on the circuit board and higher manufacturing yields which lowers product cost. However, BGA technology is not without disadvantages. For instance, solder joints cannot be easily inspected, and as a result, the design and assembly processes must be controlled to maintain the high yields and product reliability. Also, the contacts in the BGA connectors are generally unitary in design which limits design options when developing new BGA connectors.

BRIEF DESCRIPTION OF THE INVENTION

In an exemplary embodiment of the invention, an electrical contact for a ball grid array connector is provided that includes a plate for holding a solder ball and a contact body having a first end and a second end. The plate is removably coupled to the body first end. A separable interface extends from the body second end. The separable interface is configured to receive a mating contact.

Optionally, the plate includes a pair of wings on opposite sides thereof that form a cradle for the solder ball. The plate also includes a pair of notches and the body first end includes a pair of latch fingers that are received in the notches. The latch fingers retain the plate in snap fit engagement with the body. A lip on the latch fingers engages a solder carrying surface of the plate to retain the plate between the latch fingers. The contact body includes a barb to secure the contact in a connector housing.

In another embodiment of the invention, an electrical contact for a ball grid array connector is provided. The contact includes a plate for holding a solder ball, the plate having opposed notches, and a contact body having a first end and a second end. The first end includes a pair of latch fingers that are received in the notches. The latch fingers retain the plate in snap fit engagement with the body.

In another embodiment of the invention, a ball grid array connector is provided. The connector includes a housing having a mating end for receiving a mating connector, a mounting end opposite the mating end, and a plurality of contact cavities between the mating end and the mounting end. A plurality of contacts are received, one each, in the contact cavities. Each contact includes a plate for holding a solder ball and a contact body having a first end and a second end. The plate is removably coupled to the body first end. A separable interface extends from the body second end. The separable interface is configured to receive a mating contact.

DETAILED DESCRIPTION OF THE INVENTION

Figure 1:
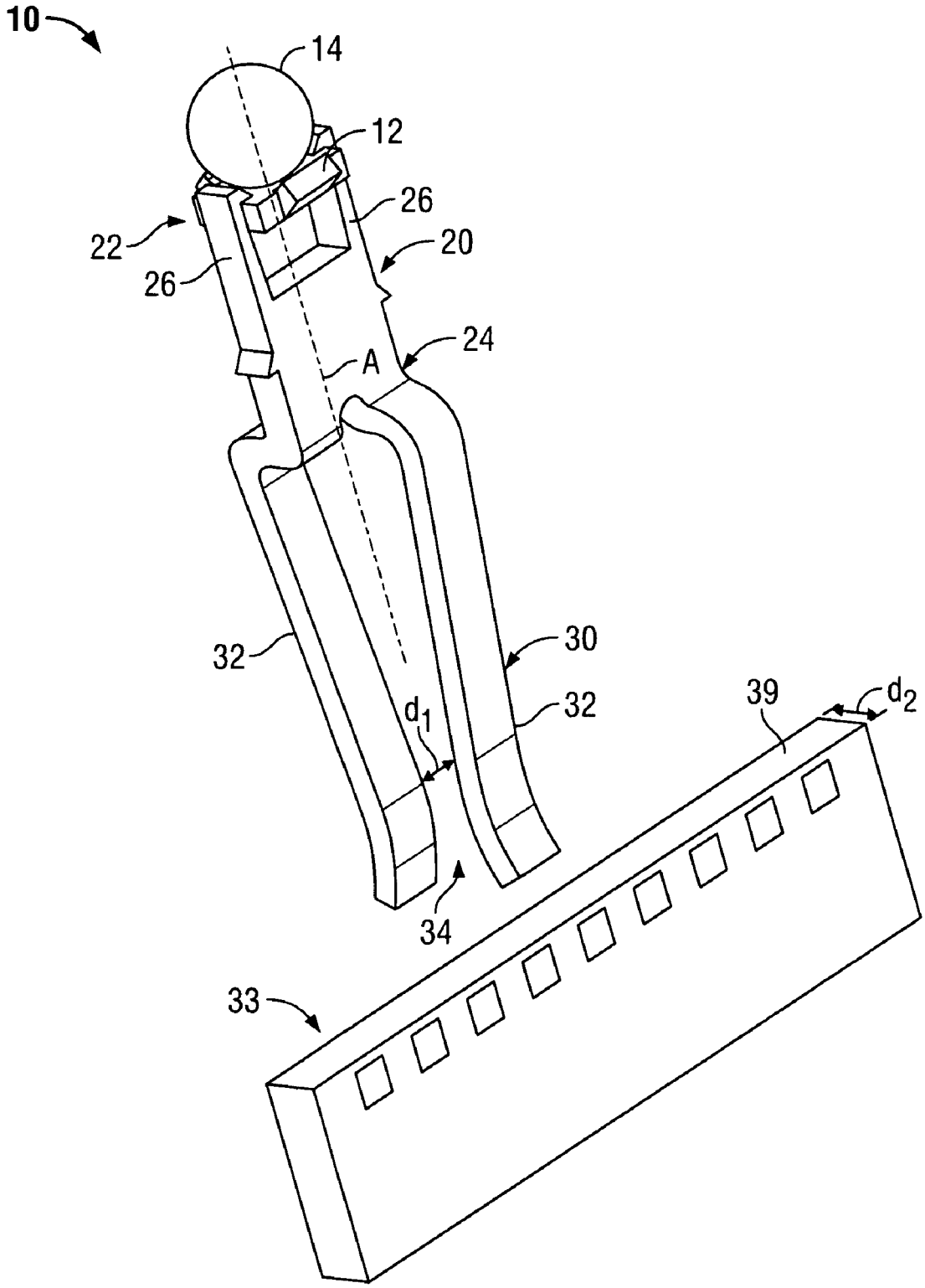
FIG. 1 is a perspective view of a ball grid array contact formed in accordance with an exemplary embodiment of the present invention.

FIG. 1 illustrates a contact 10 for a ball grid array (BGA) connector according to an exemplary embodiment of the present invention. The contact 10 is a two-piece contact that includes a plate 12 for holding a solder ball 14, and a body 20. The plate 12 is separable from the body 20 before the contact is mounted on a circuit board (not shown). The body 20 has a first end 22 and a second end 24 that define a longitudinal axis A. The first end 22 includes a pair of latch fingers 26 that hold the plate 12 when the plate 12 and body 20 are coupled together. A separable connector interface 30 extends from the body second end 24 in a direction along the longitudinal axis A.

The separable interface 30 includes a pair of legs 32 that have a gap 34 therebetween that is sized to receive a mating connector 33. The gap 34 has a minimum distance $d_1$ that is slightly less than a thickness $d_2$ of a contact edge 39 of the mating connector 33, which in one embodiment may be a circuit board wafer or other card edge connector. When the mating connector 33 is inserted between the legs 32, the legs 32 flex and are spread apart slightly which generates a clamping force on the mating connector 33 that retains the mating connector 33.

Figure 2:
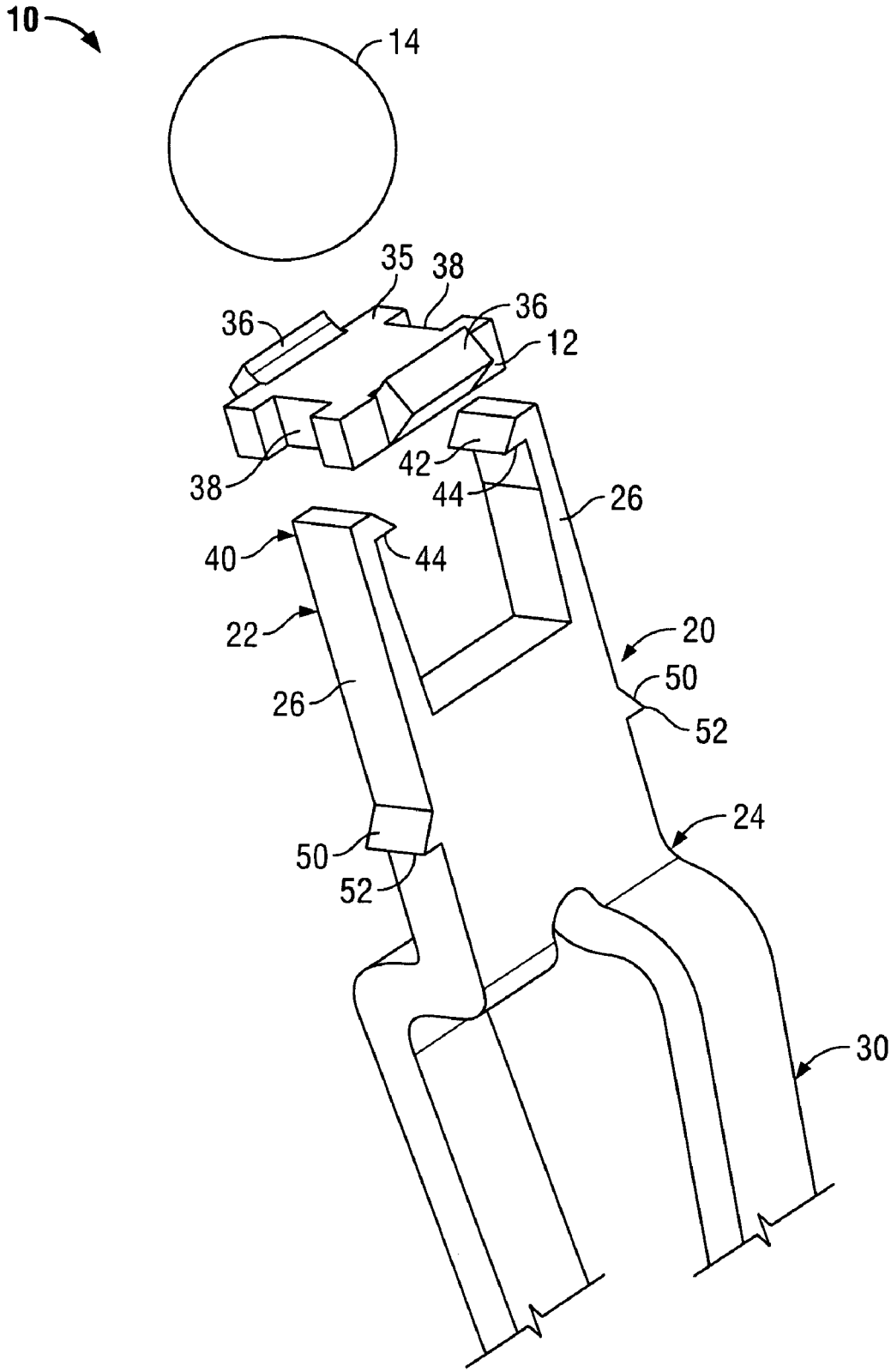
FIG. 2 is an exploded view of the contact shown in FIG. 1.

FIG. 2 is an exploded view of the contact 10. The plate 12 is generally rectangular in shape and includes a solder carrying surface 35. Though shown as generally rectangular in shape, it is to be understood the plate 12 may take other geometric shapes as well such as circular, elliptical, square, etc. When the contact 10 is mounted on a circuit board surface (not shown), the contact 10 is oriented such that the solder carrying surface 35 faces and is soldered to the circuit board. The plate 12 also includes wing elements 36 on opposite sides of the plate 12. The wing elements 36 are provided to cradle the solder ball 14 on the solder carrying surface 35. The plate 12 also has notches 38 formed therein that receive the latch fingers 26 when the plate 12 is coupled to the connector body 20.

The latch fingers 26 include an end portion 40 that is received in the notches 38 on the plate 12 to retain the plate 12 between the latch fingers. Each end portion 40 includes a bevel 42 and a lip 44. The bevel 42 facilitates insertion of the plate 12 between the latch fingers 26 along the longitudinal axis A. When the plate 12 is inserted between the fingers 26, the end portions 40 snap over the plate 12. The lip 44 engages the solder carrying surface 35 to inhibit removal of the plate 12. When the plate 12 is retained between the latch fingers 26, the end portions 40 extend beyond the solder carrying surface 35 of the plate 12 such that the bevels 42 also assist in positioning the solder ball 14 on the plate 12.

The body 20 includes one or more barbs 50 that retain the contact in a connector housing (not shown in FIG. 2). The barbs 50 have an edge 52 that is sufficiently sharp to dig into the insulative material of the housing to retain the contact in the housing.

Figure 3:
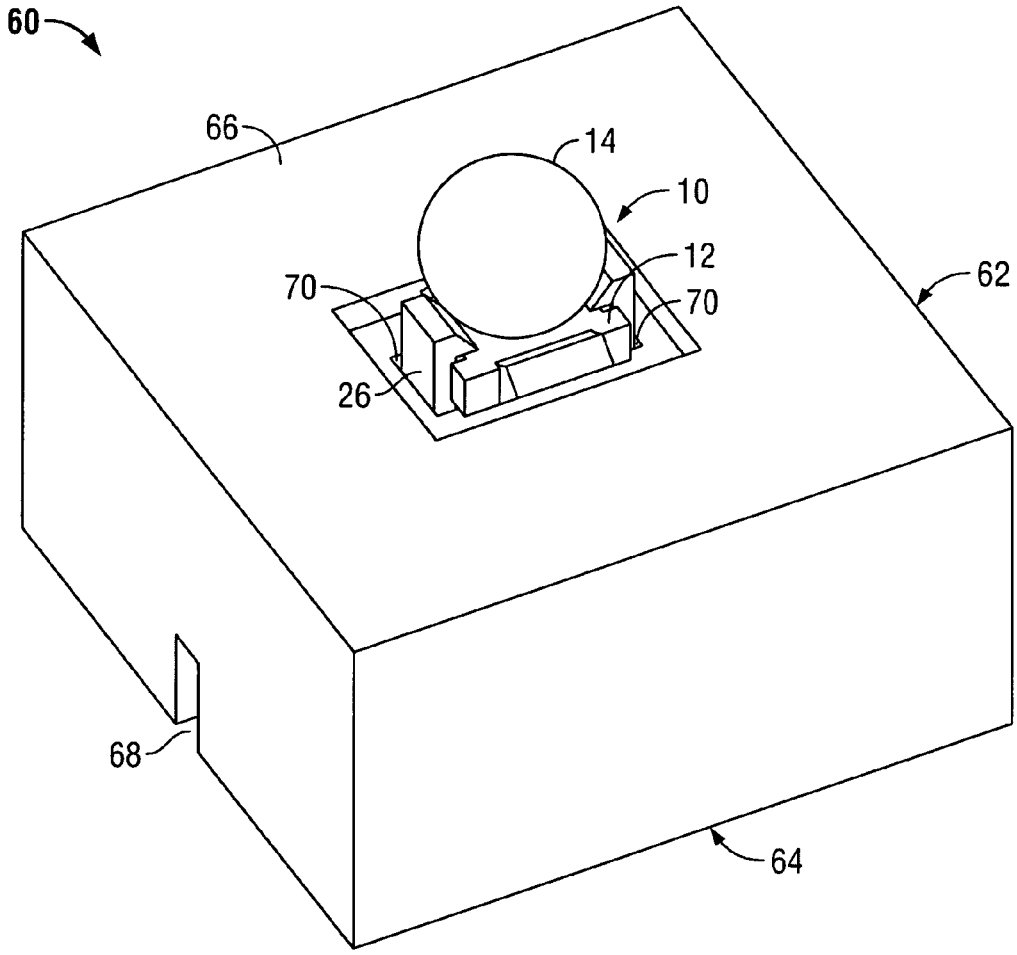
FIG. 3 is a perspective view of a segment of a ball grid array connector including the contact of FIG. 1.

FIG. 3 illustrates a segment 60 of a BGA connector that includes the contact 10 and a housing segment 62. The entire BGA connector (not shown) contains a plurality of the segments which are substantially identical to the segment 60, with the exception that the connector housing is a unitary structure having a plurality of contact cavities that accommodate a plurality of individual contacts 10. Hereinafter, the housing segment 62 will be referred to as the housing.

The housing 62 includes a mating end 64, a mounting end 66, and a slot 68 that extends through the housing mating end 64. The slot 68 is sized to receive the contact edge 39 of the mating connector 33 (shown in FIG. 1). The housing 62 also includes a contact cavity 70 that extends from the mating end 64 to the mounting end 66. The contact 10 is loaded into the contact cavity 70 in the housing 62 and oriented such that the plate 12 is positioned external to and proximate the housing mounting end 66. The contact body 20 and the separable interface 30 (see FIG. 1) are retained in the contact cavity 70 within the housing 62 with the legs 32 (see FIG. 1) of the separable interface oriented toward the housing mating end 64. More particularly, the slot 68 extends through the gap 34 (see FIG. 1) between the legs 32 such that when the contact edge 39 of the mating connector 33 is inserted in the slot 68, the contact edge 39 of the mating connector 33 is also received in the gap 34 between the legs 32 of the separable interface 30.

Figure 4:
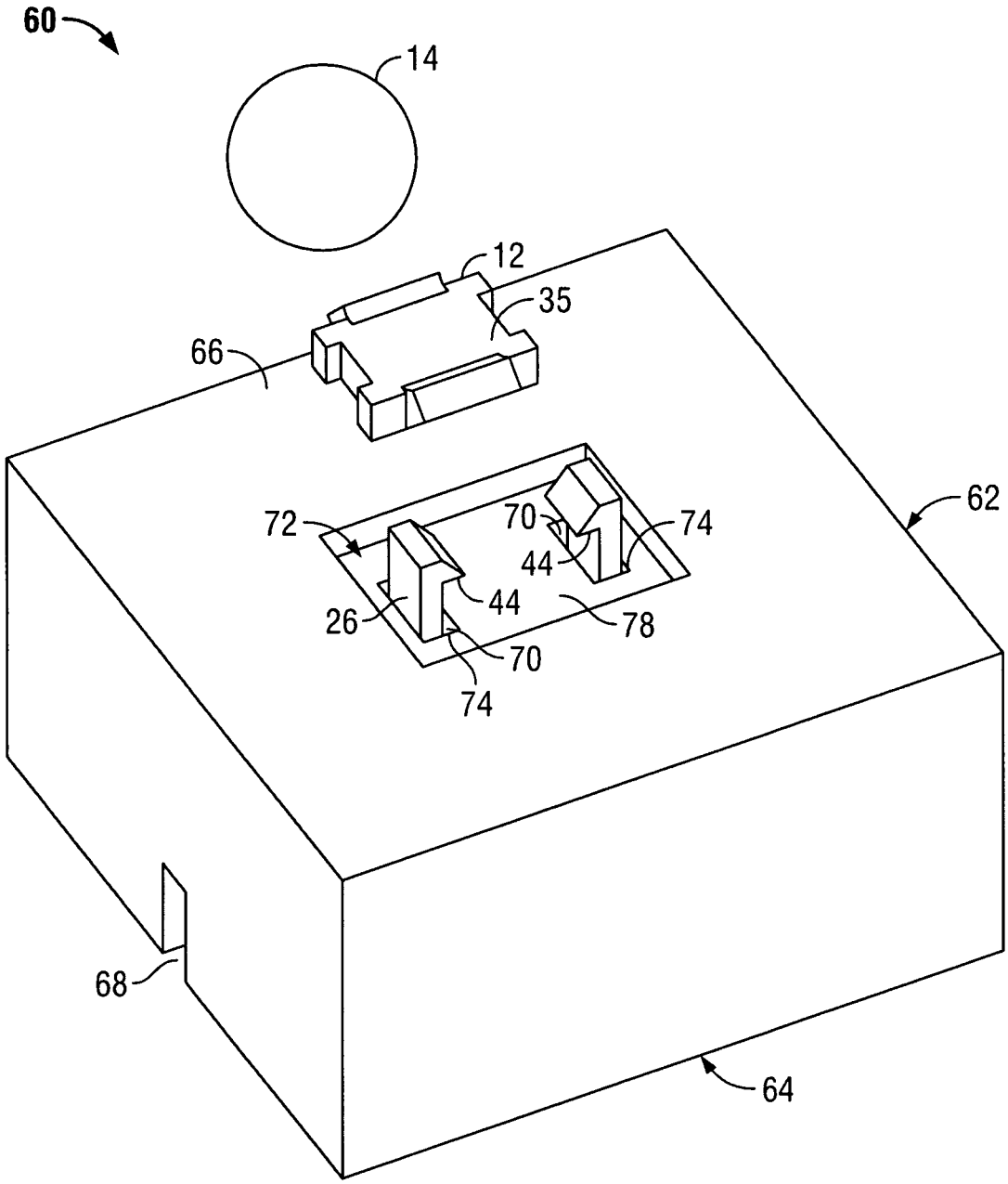
FIG. 4 is an exploded view of the connector segment shown in FIG. 3.

FIG. 4 illustrates the connector segment 60 with an exploded view of the contact 10. The housing mounting end 66 includes a recess 72 that forms a seat for the plate 12. However, it is to be understood that in other embodiments, the recess 72 may or may not be present. The housing mounting end 66 also includes apertures 74 that open into the contact cavity 70 through which the contact latch fingers 26 extend to engage and retain the plate 12. When the plate 12 is retained by the latch fingers 26, a portion of the housing mounting end 78 is captured between the plate 12 and the contact body 20. The plate 12 is outside the housing 62 while the contact body 20 is inside the housing 62.

In use, the plate 12 is separated from the contact body 20. The body 20 is then loaded into a contact cavity 70 in the housing 62 from the mating end 64 by guiding the latch fingers 26 through the apertures 74. As the body 20 is inserted into the housing 62, the barbs 50 engage the contact cavity side walls (not shown) to inhibit extraction of the body 20. When the body 20 is inserted, the separable interface 30 is oriented such that the slot 68 extends through the gap 34 (see FIG. 1) between the legs 32. So oriented, the contact edge 39 of a mating connector 33 (see FIG. 1), when inserted into the slot 68 will also be received in the gap 34 between the contact legs 32.

The plate 12 is then snapped in place between the latch fingers 26. When the plate 12 snaps into place, the lips 44 on the latch fingers 26 engage the solder carrying surface 35 of the plate 12 to inhibit removal of the plate 12. At this point, the loading of the contact 10 into the housing 62 is completed. After pasting solder balls 14 onto the plate 12, the connector 60 is prepared for mounting on a circuit board (not shown).

The embodiments thus described provide a two-piece BGA contact that is simple to use and economical to manufacture. Because the plate and the contact body can be separately manipulated, the two-piece contact allows greater versatility in the design of BGA connectors than is available with conventional unitary BGA contacts.

While the invention has been described in terms of various specific embodiments, those skilled in the art will recognize that the invention can be practiced with modification within the spirit and scope of the claims.

We claim:

1. An electrical contact for a ball grid array connector, said contact comprising:

a plate for holding a solder ball, said plate including opposed notches; and a contact body having a first end and a second end, said first end including a pair of latch fingers received in said notches, said latch fingers retaining said plate in snap fit engagement with said body.

2. The electrical contact of claim 1, further including a separable interface extending from said body second end, said separable interface configured to mate with a mating contact.

3. The electrical contact of claim 1, wherein said plate includes a pair of wings on opposite sides thereof, said wings forming a cradle for the solder ball, and wherein each said latch finger includes a portion that extends beyond a solder carrying surface of said plate to center the solder ball on said plate.

4. An electrical contact for a ball grid array connector, said contact comprising:

a plate having a solder carrying surface for holding a solder ball thereon;

a contact body having a first end and a second end, said first end including a pair of latch fingers configured to engage opposite sides of said plate, each said latch finger having a lip that engages said solder carrying surface to removably retain said plate between said latch fingers, said contact body being configured for loading into a mating end of a connector housing while separated from said plate; and a separable interface extending from said body second end, said separable interface configured to mate with a mating contact.

5. The electrical contact of claim 1, wherein said plate includes a pair of wings on opposite sides thereof, said wings forming a cradle for the solder ball.

6. The electrical contact of claim 1, wherein said plate includes a pair of notches and said latch fingers are received in said notches.

7. The electrical contact of claim 1, wherein each said latch finger includes a portion that extends beyond said solder carrying surface of said plate to center the solder ball on said plate.

8. The electrical contact of claim 1, wherein said separable interface includes a pair of legs having a gap therebetween sized to receive said mating contact.

9. A ball grid array connector comprising:

a housing having a mating end for receiving a mating connector, a mounting end opposite said mating end, and a plurality of contact cavities between said mating end and said mounting end; and a plurality of contacts, each said contact received in one of said contact cavities, each said contact comprising:

a plate having a solder carrying surface for holding a solder ball thereon;

a contact body having a first end and a second end, said first and second ends defining a longitudinal axis of the contact, said body first end including a pair of latch fingers configured to engage said plate such that said plate is removably coupled to said body first end, each said latch finger including a portion that extends beyond said solder carrying surface of said plate to center said solder ball on said plate, said contact body configured for loading into said mating end of said housing while separated from said plate; and a separable interface extending from said body second end along said longitudinal axis, said separable interface configured to mate with a mating contact.

10. The connector of claim 9 wherein a respective said solder ball is attached to said plate of each said contact.

11. The connector of claim 9, wherein each said separable interface is contained within said housing mating end.

12. The connector of claim 9, wherein each said plate includes a pair of notches and each said pair of latch fingers is received in said pair of notches.

13. The connector of claim 9, wherein each said pair of latch fingers extends through apertures in said mounting end of said housing.

14. The connector of claim 9, wherein each said pair of latch fingers extends through apertures in said mounting end of said housing to engage one of said plates, said latch fingers retaining said plate proximate an exterior surface of said mounting end of said housing.

15. The connector of claim 9, wherein each said pair of latch fingers extends through apertures in said mounting end of said housing to engage one of said plates, and a portion of said housing mounting end is captured between said contact body and said plate.

16. The connector of claim 9, wherein each said plate includes a pair of wings on opposite sides thereof, said wings forming a cradle for said solder ball.

17. The connector of claim 9, wherein each said contact body includes a barb to secure said contact in said housing.

18. The connector of claim 9, wherein each said latch finger includes a lip that engages a solder carrying surface of said plate to retain said plate between said pair of latch fingers.

* * * * *